United States Patent [19]

Rousseau

[11] Patent Number: 4,589,342

[45] Date of Patent: May 20, 1986

[54] ROCKET-POWERED TRAINING MISSILE WITH IMPACT MOTOR SPLITTING DEVICE

[75] Inventor: David G. Rousseau, Germantown, Md.

[73] Assignee: The United States of America as represented by the Secretary of the Navy, Bethesda, Md.

[21] Appl. No.: 706,825

[22] Filed: Feb. 28, 1985

[51] Int. Cl.[4] ..... F42B 13/205; F42B 15/32

[52] U.S. Cl. ..... 102/377; 102/498; 102/507; 102/518; 102/529

[58] Field of Search ..... 102/374, 377, 395, 444, 102/481, 498, 501, 518, 520, 521, 522, 523, 529, 507, 510

[56] References Cited

U.S. PATENT DOCUMENTS

| | | | |
|---|---|---|---|
| 3,032,970 | 5/1962 | Fox | 102/374 |
| 3,687,398 | 8/1972 | Beuschel | 244/3.24 |
| 3,699,891 | 10/1972 | Kreuzer et al. | 102/374 |
| 4,119,036 | 10/1978 | Hayashi et al. | 102/374 |
| 4,140,061 | 2/1979 | Campoli | 102/529 |
| 4,242,960 | 1/1981 | Boeder et al. | 102/529 |
| 4,362,107 | 12/1982 | Romer et al. | 102/520 |

*Primary Examiner*—Charles T. Jordan
*Assistant Examiner*—Ted L. Parr
*Attorney, Agent, or Firm*—Luther A. Marsh; Roger L. Maxwell

[57] ABSTRACT

A pointed splitter is placed in the body of a soft, rocket-powered training missile with the point toward the rocket motor in the rear. Upon impact, the motor is split and fragments thereof spread transversely so that the force of impact of the motor is reduced.

14 Claims, 3 Drawing Figures

ROCKET-POWERED TRAINING MISSILE WITH IMPACT MOTOR SPLITTING DEVICE

BACKGROUND OF THE INVENTION

1. Field of the Invention

This invention relates generally to a self-propelled training missile and, more particularly, to a lightweight, rocket-powered, training missile which minimizes danger to personnel and damage to property on impact.

2. Description of the Prior Art

Heretofore, many types of self-propelled training missiles have been used. Many of the self-propelled training missiles have had bodies fabricated from lightweight, crushable material within which the number, weight, and hardness of disposed elements have been minimized. The purpose of such minimization is to reduce danger to personnel and property at and in the vicinity of the missile impact site due to impact hazards, e.g., scattering fragments of missile after impact. It is especially important that such danger be reduced when the self-propelled training missile is employed as an aerial target and is launched, realistically, so as to travel on a converging course with a manned weapons platform.

Propulsion units, generally comprising a solid propellant inside a rocket motor case, generally constitute the hardest and heaviest uneliminatable components of lightweight, self-propelled, training missiles. Shortcomings in the prior art associated with relatively hard and heavy propulsion units in lightweight training missiles include insufficient absorption of propulsion unit kinetic energy upon missile impact by the missile being crushed and virtually no "spreading" of the point of impact of the propulsion unit by the missile being crushed. These shortcomings contribute to high and forceful fragmentation of propulsion units upon missile impact (especially when the impact site is a hard object) which endangers personnel and property in the vicinity of the missile impact site. Accordingly, a need has arisen for a means for more completely absorbing the kinetic energy upon missile impact of and "spreading" the point of impact of propulsion units disposed within lightweight, self-propelled, training missiles.

SUMMARY OF THE INVENTION

The present invention provides a lightweight, self-propelled, training missile which contains means for more completely absorbing the kinetic energy of and increasing the impact site of its propulsion system.

It is an object of the present invention, therefore, to provide a new and improved lightweight, self-propelled, training missile.

An additional object is to provide a lightweight, self-propelled, training missile that is relatively harmless to personnel and property in the vicinity of missile impact.

A further object of the present invention is to provide a lightweight, self-propelled, training missile which contains means for more completely absorbing propulsion unit kinetic energy upon missile impact.

Yet another object of the present invention is to provide a lightweight, self-propelled, training missile which contains means for "spreading" the point of impact of the propulsion unit disposed within said missile.

Other objects, advantages, and new features of the invention will become apparent from the following detailed description of the invention when considered in conjunction with the accompanying drawings wherein:

DESCRIPTION OF THE PREFERRED EMBODIMENTS

Figure 1:
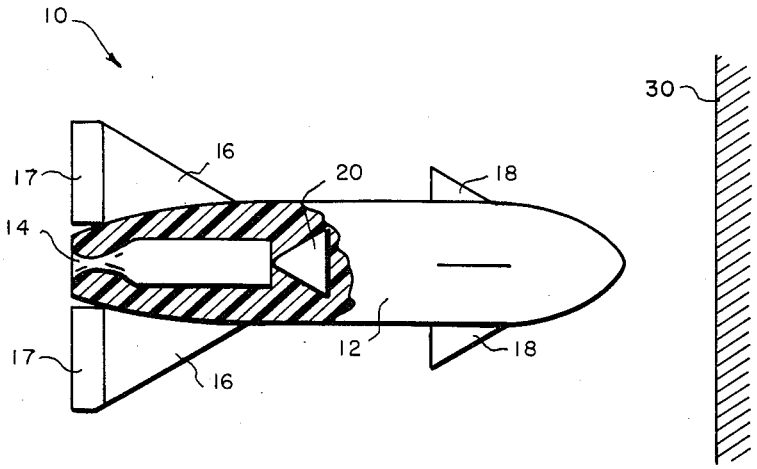
FIGS. 1, 2, and 3 are cutaway views of a lightweight, self-propelled, training missile according to the present invention which show, sequentially, said missile approaching, impacting (intially), and impacting (to the point of its motor being split) a flat-surfaced, immovable and indestructable object in the flight path of said missile.

Referring now to FIG. 1 wherein the overall arrangement of the present invention is shown as including a lightweight, self-propelled, training missile shown generally as 10. The body 12 of the missile 10 is formed from lightweight crushable energy-absorbing foam material such as a polyurethane foam, the foam material selected to provide predetermined structural characteristics which ensure integrity in flight and the capability to absorb the kinetic energy of the missile 10 upon impact, while being lightweight enough to allow free flight and to avoid danger upon impact. The body 12 is shown in the preferred embodiment as being rocket-shaped and may be of any size large enough to be seen by a weapon's crew and hold the requisite elements described hereinbelow, but otherwise should be as small as possible to minimize excess weight and impact potential. For example, it may have a wing span of 12 inches and an axial length of 36 inches. Other shapes are also possible, such as an airplane shape with two wings and a tail.

Four tail wings 16 (only two of which are shown) are made from molded foam and provide aerodynamic stability for the missile 10 in free flight. Fixed flaps 17 may be included in the wings.

Four movable canards 18, (only three of which are shown), also made of molded foam, are included toward the front of the missile 10. They may be moved under the control of a guidance control device to direct the missile 10 toward a simulated target, i.e., a site defended by a weapons crew.

The missile 10 includes a single rocket motor 14 which uses solid propellant inside a rocket motor case to provide boost and sustainer thrusts. Solid rocket motors are well known to those skilled in the art and will not be further described herein except for those characteristics thereof unique to the present invention. The case is made of a lightweight material to minimize impact hazards. For example, it could be made of fiberglass with a carbon nozzle insert. Other possible materials are phenolic/paper and rubber. A typical size for the rocket motor would be 28 inches in length and 4 inches in diameter. Such a device will provide approximately 150 pounds of boost thrust for 2 seconds and 25 pounds of sustainer thrust for 60 seconds. Amount of solid propellant used could be selected so that the propellant will be expended by the time it impacts and, hence, the missile 10 will impact with lower weight and in an inert state.

A pointed splitter 20 is placed in the body of the missile 10 with the point toward the rocket motor 14 in the rear. The splitter 20 is shown in the preferred embodiment as being cone-shaped and may be of any size and material sufficient to forcefully resist to the point of splitting the rocket motor when it passes through body material being crushed upon missile impact, but otherwise should be as small and soft as possible to minimize excess weight and impact damage potential. For example, a cast acrylic resin or fiberglass splitter with an altitude of 6 inches and a base radius of 2 inches could be used. The cone-shaped splitter 20 is further shown in the preferred embodiment as being oriented within the missile body such that the axis of the cone (and the axis of the motor) lies on the axis of symmetry of the missile body. The splitter may be of other shapes, such as pyramid shaped, and/or orientations, such as off center and parallel to the axis of symmetry of the missile body, provided that the splitter continues to be capable of splitting the rocket motor upon impact as required.

A remotely-controlled guidance system and/or devices to enhance effective radar cross section on the missile (none of which are shown) may be included in the missile to increase flight realism and/or to simulate a real missile's radar signature, respectively. Remotely-controlled guidance systems and devices to enhance effective radar cross section are well known to those skilled in the art and will not be further described herein except to specify that in the present invention size and weight of any guidance system or radar enhancing devices should be minimized so as not to produce a safety hazard upon impact. Since most of the materials used in fabricating the missile are transparent to radar waves, use of radar enhancing devices is prescribed when detection of the missile by radar is desired or critical as when employed as a converging target and the defending weapon is a radar and computer controlled system.

In operation, the missile 10, which weighs about 20 pounds, is launched toward a target, e.g., a site defended by a weapons crew. If a remotely-controlled guidance system is included in the missile 10, the flight path may be adjusted so that the missile 10 more accurately converges on the target. If radar enhancing devices are included in the missile 10, the missile 10 will provide an enhanced radar signature.

If the missile 10 is not destroyed or deflected in flight by weapons fire or by other means, it converges and impacts upon the target site.

Figure 2:
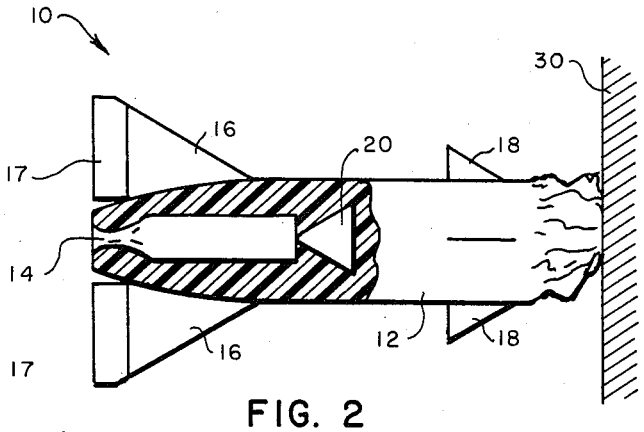
Figure 3:
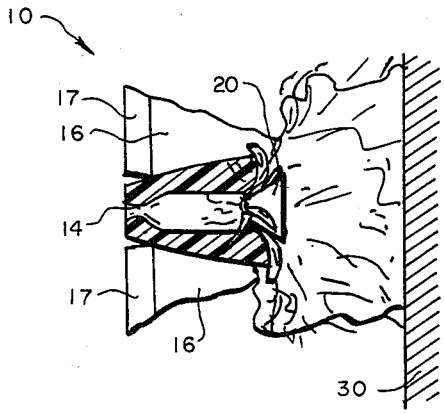

As shown in FIGS. 2 and 3, wherein the missile 10 is shown impacting with a flat-surfaced, immovable and indestructable object 30 in the flight path of said missile, upon impact, the foam body 12 of the missile 10 crushes, thereby partially absorbing the kinetic energy of the heavier missile parts disposed within. The pointed splitter 20, which resists moving toward the point of target impact because of its flat base, further serves to absorb the kinetic energy of the rocket motor 14 should the motor 14 press against the splitter 20 after impact, and still further serves to split the rocket motor 14 and to deflect constituent pieces of the rocket motor 14 transversely, should the rocket motor 14 attempt to overrun the splitter 20. If the rocket motor 14 is split and its constituent pieces deflected transversely, the area of impact of the motor 14 will be spread; likewise, force of impact of the motor 14 will be spread; and, therefore, size and speed of dispersing rocket motor pieces will be reduced so as to minimize danger to personnel and property at and in the vicinity of the impact site. Further, because of the configuration assumed by the foam body 12 as it crushes into the target site, deflected pieces of rocket motor will have to travel a greater distance through crushed foam than would nondeflected pieces; hence, speed of dispersing pieces of rocket motor will be further reduced because of inclusion in the missile body 12 of the hard pointed splitter 20 according to the present invention.

Obviously, numerous modifications and variations of the present invention are possible in light of the above teachings. It is therefore to be understood that within the scope of the appended claims, the present invention may be practiced otherwise than as specifically described hereinabove.

What is claimed is:

1. A training missile comprising:

a body adapted for aerodynamic free flight fabricated from a predetermined crushable, lightweight material;

a rocket motor disposed in a rear portion of said body; and a pointed splitter disposed in a middle portion of said body with the point toward said rocket motor;

whereby upon impact of said training missile, said pointed splitter acts to split said rocket motor and to deflect fragments of said rocket motor transversely.

2. The training missile as claimed in claim 1, wherein said pointed splitter is cone-shaped.

3. The training missile as claimed in claim 1, wherein said pointed splitter is pyramid shaped.

4. The training missile as claimed in claim 1, wherein said body has a single axis of symmetry and said pointed splitter has a single axis of symmetry which coincides with the axis of symmetry of said body.

5. The training missile as claimed in claim 1, wherein said body has a single axis of symmetry and said pointed splitter has a single axis of symmetry which is parallel to the axis of symmetry of said body.

6. The training missile as claimed in claim 1, wherein said pointed splitter is made of cast acrylic resin.

7. The training missile as claimed in claim 1, wherein said pointed splitter is made of fiberglass.

8. A training missile comprising:

a body adapted for aerodynamic free flight fabricated from a predetermined crushable, lightweight material;

a rocket motor disposed in a rear portion of said body and made of a non-metallic, lightweight material; and a pointed splitter disposed in a middle portion of said body with the point toward said rocket motor;

whereby upon impact of said training missile, said pointed splitter acts to split said rocket motor and to deflect fragments of said rocket motor transversely.

9. The training missile as claimed in claim 8, wherein said pointed splitter is cone-shaped.

10. The training missile as claimed in claim 8, wherein said pointed splitter is pyramid shaped.

11. The training missile as claimed in claim 8, wherein said body has a single axis of symmetry and said pointed splitter has a single axis of symmetry which coincides with the axis of symmetry of said body.

12. The training missile as claimed in claim 8, wherein said body has a single axis of symmetry and said pointed splitter has a single axis of symmetry which is parallel to the axis of symmetry of said body.

13. The training missile as claimed in claim 8, wherein said pointed splitter is made of cast acrylic resin.

14. The training missile as claimed in claim 8, wherein said pointed splitter is made of fiberglass.

* * * * *